US008903722B2

(12) United States Patent
Jeub et al.

(10) Patent No.: US 8,903,722 B2
(45) Date of Patent: Dec. 2, 2014

(54) NOISE REDUCTION FOR DUAL-MICROPHONE COMMUNICATION DEVICES

(75) Inventors: Marco Jeub, Aachen (DE); Christoph Nelke, Aachen (DE); Christian Herglotz, Aachen (DE); Peter Vary, Aachen (DE); Christophe Beaugeant, Mouans Sartoux (FR)

(73) Assignee: Intel Mobile Communications GmbH, Neubiberg (DE)

( * ) Notice: Subject to any disclaimer, the term of this patent is extended or adjusted under 35 U.S.C. 154(b) by 552 days.

(21) Appl. No.: 13/219,750

(22) Filed: Aug. 29, 2011

(65) Prior Publication Data

US 2013/0054231 A1 Feb. 28, 2013

(51) Int. Cl.

| | |
|---|---|
| ***G10L 21/02*** | (2013.01) |
| ***H04R 3/00*** | (2006.01) |
| ***G10L 19/03*** | (2013.01) |
| *H04R 29/00* | (2006.01) |

(52) U.S. Cl.

CPC ..... *H04R 3/005* (2013.01); *G10L 19/03* (2013.01); *H04R 29/006* (2013.01); *H04R 2460/01* (2013.01); *H04R 2499/11* (2013.01)

USPC ..... 704/226

(58) Field of Classification Search

CPC ..... G10L 19/028; G10L 19/03; G10L 21/02; G10L 2021/02; G10L 2021/02166; H04M 9/08

USPC ..... 704/226, 233

See application file for complete search history.

(56) References Cited

U.S. PATENT DOCUMENTS

| | | | | |
|---|---|---|---|---|
| 5,943,429 | A * | 8/1999 | Handel | 381/94.2 |
| 6,717,991 | B1 * | 4/2004 | Gustafsson et al. | 375/285 |
| 7,099,822 | B2 * | 8/2006 | Zangi | 704/226 |
| 7,826,623 | B2 * | 11/2010 | Christoph | 381/92 |
| 8,358,796 | B2 * | 1/2013 | Puder | 381/317 |
| 8,374,358 | B2 * | 2/2013 | Buck et al. | 381/94.1 |
| 2007/0280472 | A1 | 12/2007 | Stokes, III et al. | |
| 2009/0220107 | A1 * | 9/2009 | Every et al. | 381/94.7 |
| 2010/0329492 | A1 | 12/2010 | Derleth et al. | |

FOREIGN PATENT DOCUMENTS

| | | | |
|---|---|---|---|
| CN | 101816191 | A | 8/2010 |
| CN | 102026080 | A | 4/2011 |
| CN | 102075831 | A | 5/2011 |
| EP | 1538867 | A1 | 6/2005 |
| WO | 2010/091077 | A1 | 8/2010 |
| WO | 2011/101045 | A1 | 8/2011 |

OTHER PUBLICATIONS

McCowan et al.; Microphone Array Post-Filter Based on Noise Field Coherence; IEEE Transactions on Speech and Audio processing, vol. 11, No. 6, pp. 709-716. Nov. 2003.* Aarabi et al.; Phase-Based Dual-Microphone Robust Speech Enhancement; IEEE Transactions on systems, man, and cybernetics—Part B: Cybernetics, vol. 34, No. 4, pp. 1763-1773. Aug. 2004.*

Office action received for China Patent Application No. 201210313653.6, mailed on Feb. 28, 2014, 6 pages of Office action and 10 pages of English Translations.

Office action received for German Patent Application No. 10 2012 107 952.8, mailed on Jun. 5, 2014, 12 pages of office action including 5 pages of English translation.

* cited by examiner

*Primary Examiner* — Abul Azad

(57) ABSTRACT

A method, system, and computer program product for managing noise in a noise reduction system, comprising: receiving a first signal at a first microphone; receiving a second signal at a second microphone; identifying noise estimation in the first signal and the second signal; identifying a transfer function of the noise reduction system using a ratio of a power spectral density of the second signal minus the noise estimation to a power spectral density of the first signal, wherein the noise estimation is removed from only the power spectral density of the second signal; and identifying a gain of the noise reduction system using the transfer function.

26 Claims, 8 Drawing Sheets

NOISE REDUCTION FOR DUAL-MICROPHONE COMMUNICATION DEVICES

TECHNICAL FIELD

Various embodiments relate generally to noise reduction systems, such as in communication devices, for example. In particular, the various embodiments relate to a noise reduction in dual-microphone communication devices.

BACKGROUND

Noise reduction is the process of removing noise from a signal. Noise may be any undesirable sound that is present in the signal. Noise reduction techniques are conceptually very similar regardless of the signal being processed, however a priori knowledge of the characteristics of an expected signal can mean the implementations of these techniques vary greatly depending on the type of signal.

All recording devices, both analogue and digital, have traits which make them susceptible to noise. Noise can be random or white noise with no coherence, or coherent noise introduced by a mechanism of the device or processing algorithms.

In electronic recording devices, a form of noise is hiss caused by random electrons that, heavily influenced by heat, stray from their designated path. These stray electrons may influence the voltage of the output signal and thus create detectable noise.

Algorithms for the reduction of background noise are used in many speech communication systems. Mobile phones and hearing aids have integrated single- or multi-channel algorithms to enhance the speech quality in adverse environments. Among such algorithms, one method is the spectral subtraction technique which generally requires an estimate of the power spectral density (PSD) of the unwanted background noise. Different single-channel noise PSD estimators have been proposed. Multi-channel noise PSD estimators for systems with two or more microphones have not been studied very intensively.

SUMMARY

A method, system, and computer program product for managing noise in a noise reduction system, comprising: receiving a first signal at a first microphone; receiving a second signal at a second microphone; identifying noise estimation in the first signal and the second signal; identifying a transfer function of the noise reduction system using a ratio of a power spectral density of the second signal minus the noise estimation to a power spectral density of the first signal, wherein the noise estimation is removed from only the power spectral density of the second signal; and identifying a gain of the noise reduction system using the transfer function.

A method, system, and computer program product for estimating noise in a noise reduction system, comprising: receiving a first signal at a first microphone; receiving a second signal at a second microphone; identifying a normalized difference in the power level of the first signal and the power level of the second signal; and identifying a noise estimation using the difference in the power level of the first signal and the power level of the second signal.

A method, system, and computer program product for estimating noise in a noise reduction system, comprising: receiving a first signal at a first microphone; receiving a second signal at a second microphone; identifying a coherence between the first signal and the second signal; and identifying a noise estimation using the coherence.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced. The word "exemplary" is used herein to mean "serving as an example, instance, or illustration". Any embodiment or design described herein as "exemplary" is not necessarily to be construed as preferred or advantageous over other embodiments or designs.

Note that in this Specification, references to various features (e.g., elements, structures, modules, components, steps, operations, characteristics, etc.) included in "one embodiment", "example embodiment", "an embodiment", "another embodiment", "some embodiments", "various embodiments", "other embodiments", "different embodiments", "alternative embodiment", and the like are intended to mean that any such features are included in one or more embodiments of the present disclosure, and may or may not necessarily be combined in the same embodiments.

The various embodiments take into account and recognize that existing algorithms for noise reduction are of a high computational complexity, memory consumption, and difficulty in estimating non-stationary noise. Additionally, the various embodiments take into account and recognize that any existing algorithms capable of tracking non-stationary noise are only single-channel. However, even single-channel algorithms are mostly not capable of tracking non-stationary noise.

Additionally, the various embodiments provide a dual-channel noise PSD estimator which uses knowledge about the noise field coherence. Also, the various embodiments provide a process with low computational complexity and the process may be combined with other speech enhancement systems.

Additionally, the various embodiments provide a process for a scalable extension of an existing single-channel noise suppression system by exploiting a secondary microphone channel for a more robust noise estimation. The various embodiments provide a dual-channel speech enhancement system by using a priori knowledge of the noise field coherence in order to reduce unwanted background noise in diffuse noise field conditions.

The foregoing has outlined rather broadly the features and technical advantages of the different illustrative embodiments in order that the detail description of the invention that follows may be better understood. Additional features and advantages of the different illustrative embodiments will be described hereinafter. It should be appreciated by those skilled in the art that the conception and the specific embodiments disclosed may be readily utilized as a basis for modifying or redesigning other structures or processes for carrying out the same purposes of the different illustrative embodiments. It should also be realized by those skilled in the art that such equivalent constructions do not depart form the spirit and scope of the invention as set forth in the appended claims.

Figure 1:
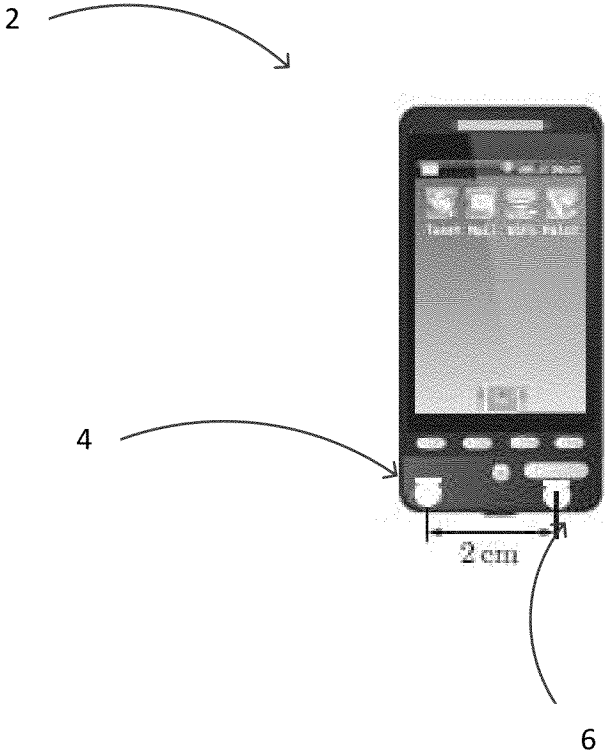
FIG. 1 is a view of a device in accordance with an illustrative embodiment.

FIG. 1 is a view of a device in accordance with an illustrative embodiment. Device 2 is user equipment with microphones 4 and 6. Device 2 may be a communications device, mobile phone, or some other suitable device with microphones. In different embodiments, device 2 may have more or fewer microphones. Device 2 may be a smartphone, tablet personal computer, headset, personal computer, or some other type of suitable device which uses microphones to receive sound. In this embodiment, microphones 4 and 6 are shown approximately 2 cm apart. However, the microphones may be placed at various distances in other embodiments. Additionally, microphones 4 and 6, as well as other microphones may be placed on any surface of device 2 or may be wirelessly connected and located remotely.

Figure 2:
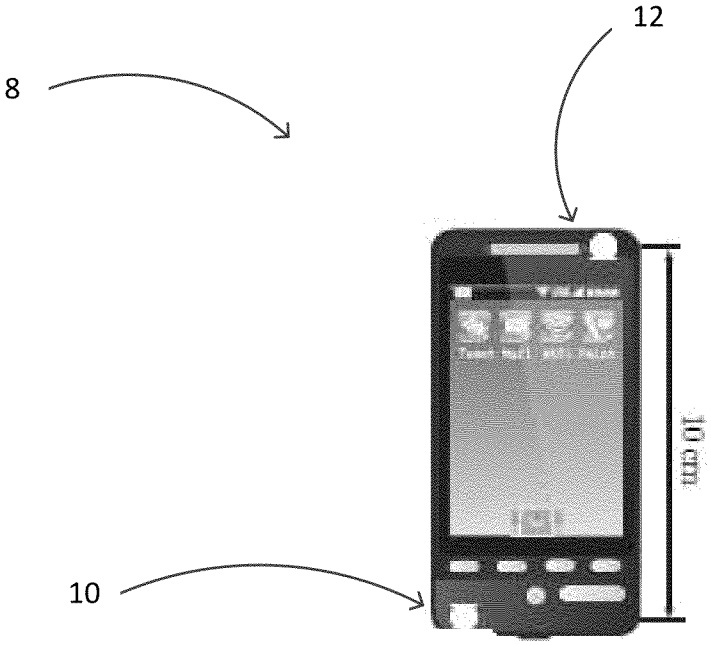
FIG. 2 is a view of a device in accordance with an illustrative embodiment.

FIG. 2 is a view of a device in accordance with an illustrative embodiment. Device 8 is user equipment with microphones 10 and 12. Device 8 may be a communications device, mobile phone, or some other suitable device with microphones. In different embodiments, device 8 may have more or fewer microphones. Device 8 may be a smartphone, tablet personal computer, headset, personal computer, or some other type of suitable device which uses microphones. In this embodiment, microphones 10 and 12 are approximately 10 cm apart. However, the microphones may be positioned at various distances and placements in other embodiments. Additionally, microphones 10 and 12, as well as other microphones may be placed on any surface of device 8 or may be wirelessly connected and located remotely.

Figure 3:
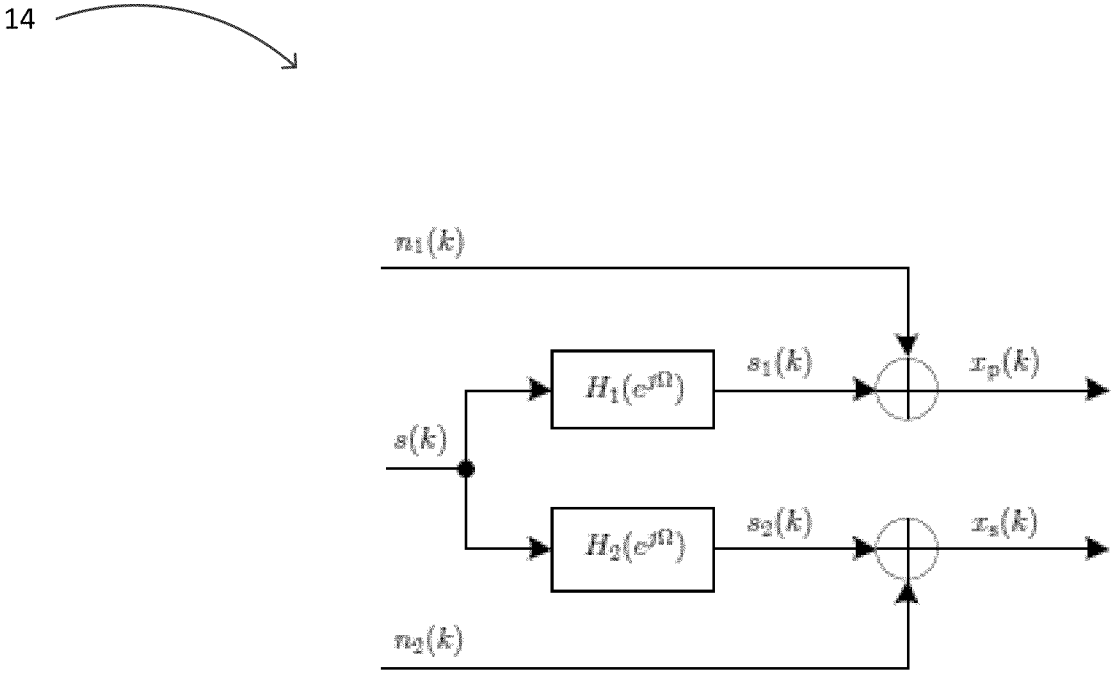
FIG. 3 is a signal model in accordance with an illustrative embodiment.

FIG. 3 is a signal model in accordance with an illustrative embodiment. Signal model 14 is a dual-channel signal model. The two microphone signals xp(k) and xs(k) are the inputs of the dual-channel speech enhancement system and are related to clean speech s(k) and additive background noise signals n1(*k*) and n2(*k*) by signal model 14, with discrete time index k. The acoustic transfer functions between source and the microphones are denoted by H1(*ej*Ω) and H2(*ej*Ω). The normalized radian frequency is given by Ω=2πf/fs with frequency variable f and sampling frequency fs. The source at each microphone is s1(*k*) and s2(*k*) respectively. Once noise is added to the source, it is picked up by each microphone as xp(k) and xs(k), also referred to herein as x1(*k*) and x2(*k*), respectively.

Figure 4:
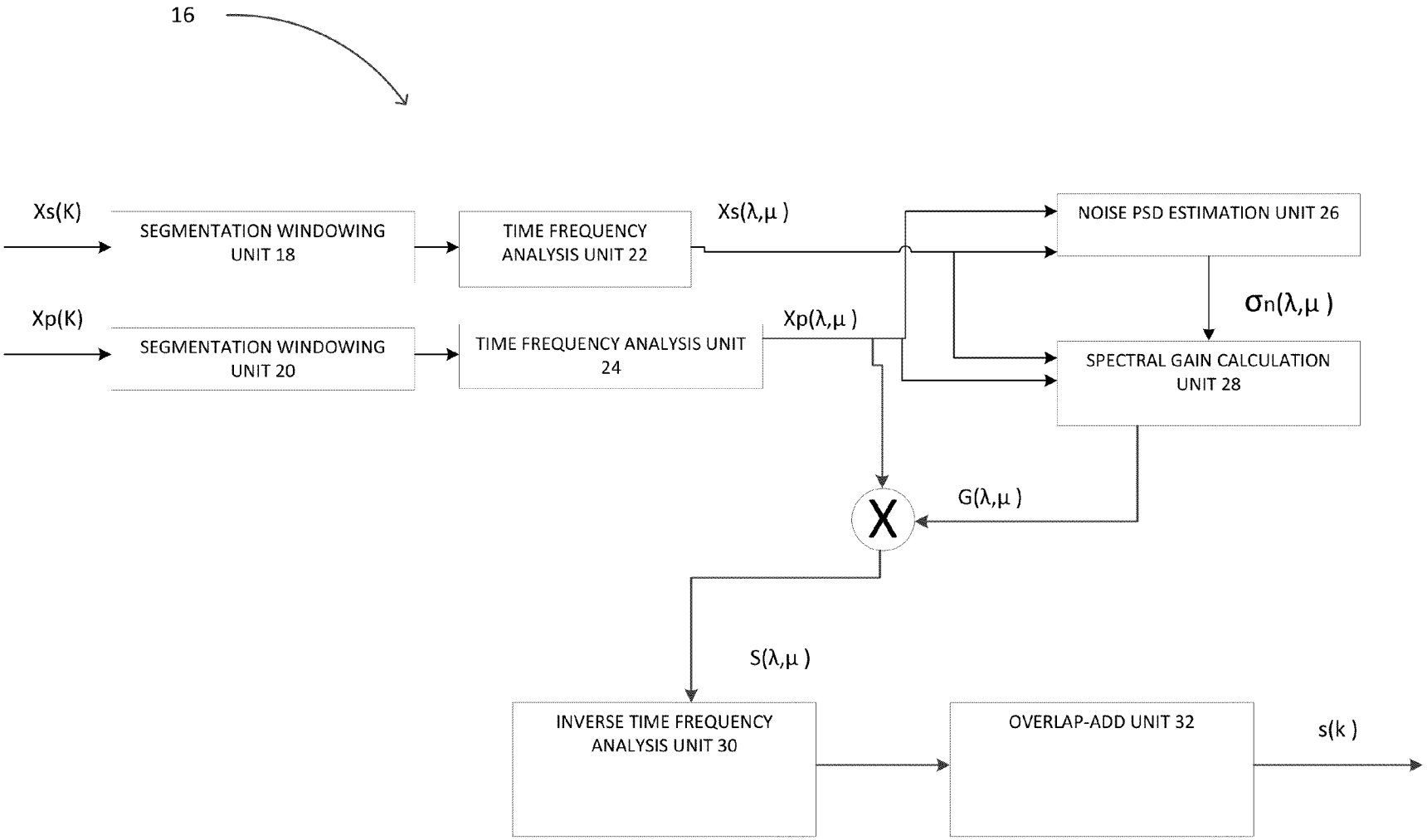
FIG. 4 is a block diagram of a speech enhancement system in accordance with an illustrative embodiment.

FIG. 4 is a block diagram of a speech enhancement system in accordance with an illustrative embodiment. Speech enhancement system 16 is a dual-channel speech enhancement system. In other embodiments, speech enhancement system 16 may have more than two channels.

Speech enhancement system 16 includes segmentation windowing units 18 and 20. Segmentation windowing units 16 and 18 segment the input signals xp(k) and xs(k) into overlapping frames of length L. Herein, xp(k) and xs(k) may also be referred to as x1(*k*) and x2(*k*). Segmentation windowing units 16 and 18 may apply a Hann window or other suitable window. After windowing, time frequency analysis units 22 and 24 transform the frames of length M into the short-term spectral domain. In one or more embodiments, the time frequency analysis units 22 and 24 use a fast Fourier transform (FFT). In other embodiments, other types of time frequency analysis may be used. The corresponding output spectra are denoted by Xp(λ,μ) and Xs(λ,μ). Discrete frequency bin and frame index are denoted by μ and λ, respectively.

The noise power spectral density (PSD) estimation unit 26 calculates the noise power spectral density estimation $\hat{\phi}_{nn}(\lambda,\mu)$ for a frequency domain speech enhancement system. The noise power spectral density estimation may be calculated by using xp(k) and xs(k) or in the frequency domain by Xp(λ,μ) and Xs(λ,μ). The noise power spectral density may also be referred to as the auto-power spectral density.

Spectral gain calculation unit 28 calculates the spectral weighting gains G(λ,μ). Spectral gain calculation unit 28 uses the noise power spectral density estimation and the output spectra Xp(λ,μ) and Xs(λ,μ).

The enhanced spectrum $\hat{S}(\lambda,\mu)$ is given by the multiplication of the coefficients Xp(λ, μ) with the spectral weighting gains G(λ,μ). Inverse time frequency analysis unit 30 applies an inverse fast Fourier transform to $\hat{S}(\lambda,\mu)$ and then and overlap-add is applied by overlap-add unit 32 to produce the enhanced time domain signal ŝ(k). Inverse time frequency analysis unit 30 may use an inverse fast Fourier transform or some other type of inverse time frequency analysis.

It should be noted that a filtering in the time-domain by means of a filter-bank equalizer or using any kind of analysis or synthesis filter bank is also possible.

Figure 5:
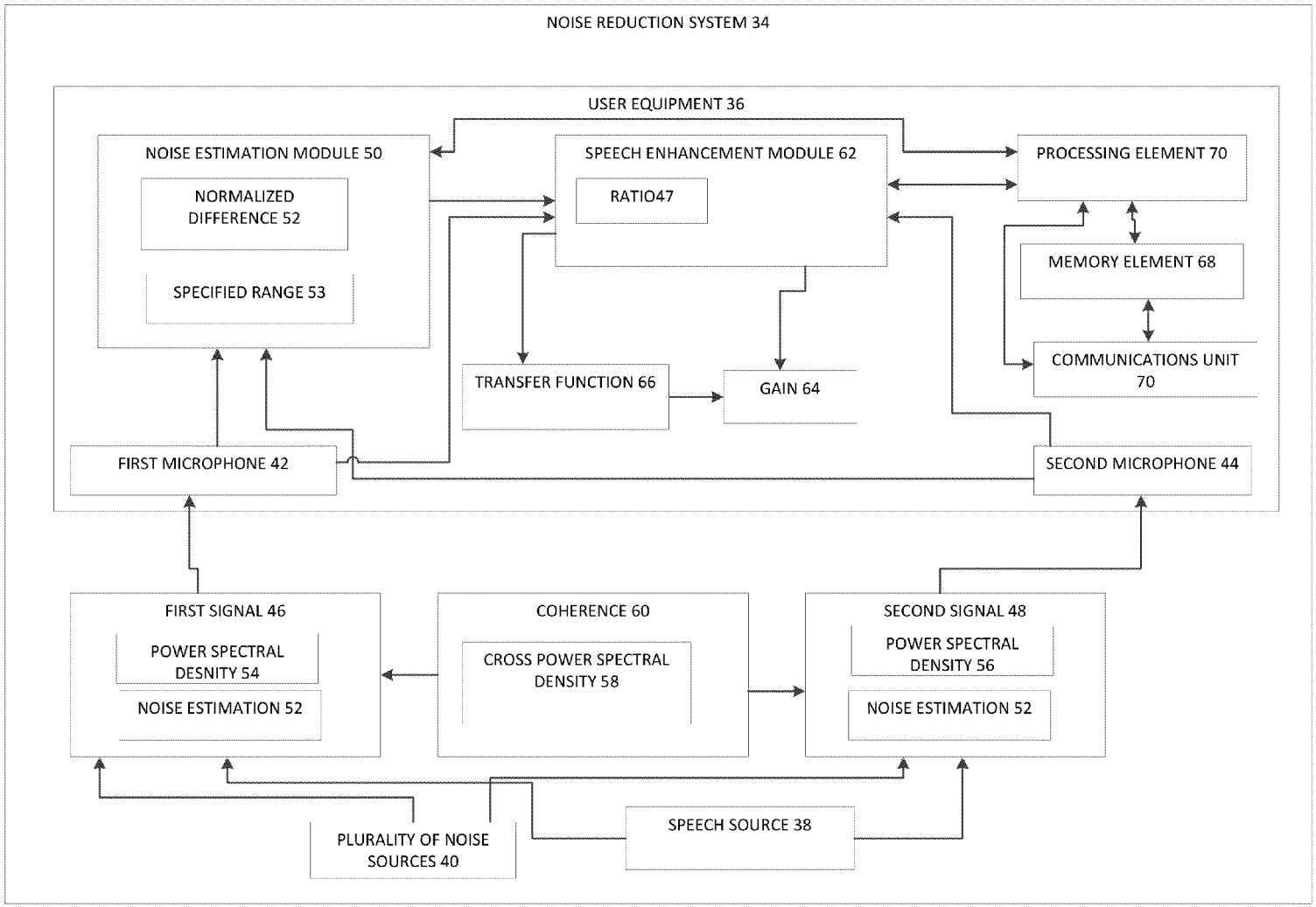
FIG. 5 is a block diagram of a noise reduction system in accordance with an illustrative embodiment.

FIG. 5 is a block diagram of a noise reduction system in accordance with an illustrative embodiment. Noise reduction system 34 is a system in which one or more devices may receive signals through microphones for processing. Noise reduction system 34 may include user equipment 36, speech source 38, and plurality of noise sources 40. In other embodiments, noise reduction system 34 includes more than one user equipment 36 and/or more than one speech source 38. User equipment 36 may be one example of one implementation of user equipment 8 of FIG. 2 and/or user equipment 2 of FIG. 1.

Speech source 38 may be a desired audible source. The desired audible source is the source that produces an audible signal that is desirable. For example, speech source 38 may be a person who is speaking simultaneously into first microphone 42 and second microphone 44. In contrast, plurality of noise sources 40 may be undesirable audible sources. Plurality of noise sources 40 may be background noise. For example, plurality of noise sources 40 may be a car engine, fan, or other types of background noise. In one or more embodiments, speech source 38 may be close to first microphone 42 than second microphone 44. In different advantageous embodiments, speech source 38 may be equidistant from first microphone 42 and second microphone 44, or close to second microphone 44.

Speech source 38 and plurality of noise sources 40 emit audio signals that are received simultaneously or with a certain time-delay due to the difference sound wave propagation time between sources and first microphone 42 and sources and second microphone 44 by first microphone 42 and second microphone 44 each as a portion of a combined signal. First microphone 42 may receive a portion of the combined signal in the form of first signal 46. Second microphone 44 may receive a portion of the combined signal in the form of second signal 48.

User equipment 36 may be used for receiving speech from a person and then transmitting that speech to another piece of user equipment. During the reception of the speech, unwanted background noise may be received as well from plurality of noise sources 40. Plurality of noise sources 40 forms the part of first signal 46 and second signal 48 that may be undesirable sound. Background noise produced from plurality of noise sources 40 may be undesirable and reduce the quality and clarity of the speech. Therefore, noise reduction system 34 provides systems, methods, and computer program products to reduce and/or remove the background noise received by first microphone 42 and second microphone 44.

An estimation of the background noise may be identified and used to remove and/or reduce undesirable noise. Noise estimation module 50, located in user equipment 36, identifies noise estimation 52 in first signal 46 and second signal 48 by using a power-level equality (PLE) algorithm which exploits power spectral density differences among first microphone 42 and second microphone 44. The equation is:

$$\Delta\phi(\lambda,\mu)=\left|\frac{\phi_{X1X1}(\lambda,\mu)-\beta\phi_{X2X2}(\lambda,\mu)}{\phi_{X1X1}(\lambda,\mu)+\beta\phi_{X2X2}(\lambda,\mu)}\right|, \quad \text{Equation 1}$$

wherein $\Delta\phi(\lambda,\mu)$ is normalized difference 52 in power spectral density 54 of first signal 46 and power spectral density 56 of the second signal 48, $\beta$ is a weighting factor, $\phi_{X1X1}(\lambda,\mu)$ is power spectral density 54 of first signal 46, and $\phi_{X2X2}(\lambda,\mu)$ is power spectral density 56 of second signal 48. $\phi_{X1X1}(\lambda,\mu)$ and $\phi_{X2X2}(\lambda,\mu)$ may represent x1($k$) and x2($k$), respectively. In different embodiment, the absolute value may or may not be taken in Equation 1.

Normalized difference 52 may be The difference of the power levels $\phi_{X1X1}(\lambda,\mu)$ and $\phi_{X2X2}(\lambda,\mu)$ relative to the sum of $\phi_{X1X1}(\lambda,\mu)$ and $\phi_{X2X2}(\lambda,\mu)$ First signal 46 and second signal 48 may be different audio signal and sound from different sources. Power spectral density 54 and power spectral density 56 may be a positive real function of a frequency variable associated with a stationary stochastic process, or a deterministic function of time, which has dimensions of power per hertz (Hz), or energy per hertz. Power spectral density 54 and power spectral density 56 may also be referred to as the spectrum of a signal. Power spectral density 54 and power spectral density 56 may measure the frequency content of a stochastic process and helps identify periodicities.

Different embodiments taken into account different conditions. For example, one or more embodiments take into account that the plurality of noise sources 40 produces noise that is homogeneous where the noise power level is equal in both channels. It is not relevant whether the noise is coherent or diffuse in those embodiments. Under other embodiments, it may be relevant that the noise is coherent or diffuse.

Under various inputs, the equation will have differing results. For example, when there is only diffuse background noise $\Delta\phi(\lambda,\mu)$ will be close to zero as the input power levels are almost equal. Hence, the input at first microphone 42 can be used as the noise-PSD. Secondly, regarding the case that there is just pure speech and the power of speech in second microphone 44 is very low compared to first microphone 42, the value of $\Delta\phi(\lambda,\mu)$ will be close to one. As a result the estimation of the last frame will be kept. When the input is in between these two extremes shown above, a noise estimation using second microphone 44 will be used as approximation of noise estimation 52. The different approaches are used based on specified range 53. Specified range 53 is between $\phi$min and $\phi$max. The three different approaches are shown in the following equations depending where in specified range 53, normalized difference 52 falls:

when $\Delta\phi(\lambda,\mu)<\phi\text{min}$ then use, $$\sigma_N^2(\lambda,\mu)=\alpha\cdot\sigma_N^2(\lambda-1,\mu)+(1-\alpha)\cdot|X_1|^2(\lambda,\mu), \text{ where } |X_1|^2(\lambda,\mu) \quad \text{Equation 1.1}$$

is cross power spectral density 58 of first signal 46 and second signal 48;

when $\Delta\phi(\lambda,\mu)>\phi\text{max}$ then use, $\sigma_N^2(\lambda,\mu)=\sigma_N^2(\lambda-1,\mu)$, in different embodiments, other methods may be employed which also works in periods of speech presence;

when $\phi\text{min}<\Delta\phi(\lambda,\mu)<\phi\text{max}$ then use, $$\sigma_N^2(\lambda,\mu)=\alpha\cdot\sigma_N^2(\lambda-1,\mu)+(1-\alpha)\cdot|X_2|^2(\lambda,\mu), \quad \text{Equation 1.2}$$

wherein $X_1$ is the time domain coefficient of the signal x1($k$) and $X_2$ is the time domain coefficient of the signal x2($k$).

Fixed or adaptive values may be used for $\phi$min, $\phi$max, and $\alpha$. The term $\sigma_N^2(\lambda,\mu)$ may be noise estimation 52. The values of a in Equation 1.1 and Equation 1.2 may be different or the same. The term 2 may be defined as the discrete frame index. The term $\mu$ may be defined as the discrete frequency index. The term $\alpha$ may be defined as the smoothing factor.

In speech processing applications, the speech signal may be segmented in frames ($\lambda$). These frames are then transformed into the frequency domain ($\mu$), the short time spectrum $X_1$. To get a more reliable measure of the power spectrum of a signal the short time spectra are recursively smoothed over consecutive frames. The smoothing over time provides the PSD estimates in Equation 1.3-1.5.

In some embodiments, the equation is realized in the short-term spectral domain and the required PSD terms in Equation 1 are estimated recursively by means of the discrete short-time estimates according to the following equations:

$$\hat{\phi}_{X1X1}(\lambda,\mu)=\beta\hat{\phi}_{X1X1}(\lambda-1,\mu)+(1-\beta)|X_1(\lambda,\mu)|^2; \quad \text{Equation 1.3}$$

$$\hat{\phi}_{X2X2}(\lambda,\mu)=\beta\hat{\phi}_{X2X2}(\lambda-1,\mu)+(1-\beta)|X_2(\lambda,\mu)|^2; \text{ and} \quad \text{Equation 1.4}$$

$$\hat{\phi}_{X1X2}(\lambda,\mu)=\beta\hat{\phi}_{X1X2}(\lambda-1,\mu)+(1-\beta)X_1(\lambda,\mu)\cdot X_2^*(\lambda,\mu), \quad \text{Equation 1.5}$$

wherein $\beta$ is a fixed or adaptive smoothing factor and is $0\leq\beta\leq1$ and * denotes the complex conjugate.

Additionally, in different embodiments, a combination with alternative single-channel or dual-channel noise PSD estimators is also possible. Depending on the estimator this combination can be based on the minimum, maximum, or any kind of average, per frequency band and/or a frequency dependent combination.

In one or more embodiments, noise estimation module 50 may use another system and method for identifying noise estimation 52. Noise estimation module 50 may identifying coherence 60 between first signal 46 and the second signal 48 then identify noise estimation 52 using coherence 60.

The different illustrative embodiments recognize and take into account that current methods use estimators for the speech PSD based on the noise field coherence derived and incorporated in a Wiener filter rule for the reduction of diffuse background noise. One or more illustrative embodiments provide a noise PSD estimate for versatile application in any spectral noise suppression rule. The complex coherence between first signal 46 and second signal 48 is defined in the frequency domain by the following equation:

$$\Gamma_{X1X2}(\lambda,\mu)=\frac{\phi_{X1X2}(\lambda,\mu)}{\sqrt{\phi_{X1X1}(\lambda,\mu)\times\phi_{X2X2}(\lambda,\mu)}} \quad \text{Equation 2}$$

In different illustrative embodiments, when the noise sources n1($k$) and n2($k$), from FIG. 3 are uncorrelated with the speech signals s(k) from FIG. 3, the auto-power spectral density and cross power spectral density at the input of the speech enhancement system xp(k) and xs(k) read:

$$\phi_{X1X1}=\phi_{SS}+\phi_{n1n1};$$

$$\phi_{X2X2}=\phi_{SS}+\phi_{n2n2}; \text{ and}$$

$$\phi_{X1X2}=\phi_{SS}+\phi_{n1n2},$$

wherein $\phi_{SS}=\phi_{S1S1}=\phi_{S2S2}$, and wherein $\phi_{SS}$ is the power spectral density of the speech, $\phi_{n1n1}$ is the auto-power spectral density of the noise at first microphone 42, $\phi_{n2n2}$ is the auto-power spectral density of the noise at second microphone 44, and $\phi_{n1n2}$ is the cross-power spectral density of the noise both microphones.

When applied to Equation 2, the coherence of the speech signals is $\Gamma_{X1X2}(\lambda,\mu)=1$. In different embodiments, coherence 60 may be close to 1 if the sound source to microphone distance is smaller than a critical distance. The critical distance may be defined as the distance from the source at which the sound energy due to the direct-path component of the signal is equal to the sound energy due to reverberation of the signal.

Furthermore, various embodiments may take into account that the noise field is characterized as diffuse, where the coherence of the unwanted background noise nm(k) is close to zero, except for low frequencies. Additionally, various embodiments may take into account a homogeneous diffuse noise field results in $\phi_{n1n1}=\phi_{n2n2}=\sigma_N^2$. In some of the below equations, the frame and frequency indices ($\lambda$ and $\mu$) may be omitted for clarity. In various embodiments, Equation 2 may be reordered as follows:

$$\phi_{n1n2}=\Gamma_{n1n2}\sqrt{\phi_{n1n2}\cdot\phi_{n2n2}}=\Gamma_{n1n2}\cdot\sigma_N^2,$$

wherein $\Gamma_{n1n2}$ may be an arbitrary noise field model such as in an uncorrelated noise field where $$\Gamma_{X1X2}(\lambda,\mu)=0, \text{ or}$$

in an ideal homogeneous spherically isotropic noise field where $$\Gamma_{X1X2}(\lambda,\mu)=\operatorname{sinc}\left(\frac{2\pi f d_{mic}}{c}\right),$$

Wherein $d_{mic}$ is distance between two omnidirectional microphones at frequency f and sound velocity c.

Therefore, the auto-power spectral density may be folinulated as:

$$\phi_{X1X1}=\phi_{SS}+\sigma_N^2; \text{ and}$$

$$\phi_{X2X2}=\phi_{SS}+\sigma_N^2.$$

Also, the cross-power spectral density may be formulated as:

$$\phi_{X1X2}=\phi_{SS}+\Gamma_{n1n2}\cdot\sigma_N^2.$$

With the geometric mean of the two auto-power spectral densities as:

$$\sqrt{\phi_{X1X2}\cdot\phi_{X2X2}}=\phi_{SS}+\sigma_N^2,$$

and the reordering of cross-power spectral density to:

$$\phi_{SS}=\phi_{X1X2}-\Gamma_{n1n2}\cdot\sigma_N^2$$

the following equation may be formulated:

$$\sqrt{\phi_{X1X1}\cdot\phi_{X2X2}}=\phi_{X1X2}+\sigma_N^2(1-\Gamma_{n1n2}).$$

Based on the above equation, the real-value noise PSD estimate is:

$$\sigma_N^2(\lambda,\mu)=\frac{\sqrt{\phi_{X1X1}(\lambda,\mu)\times\phi_{X2X2}(\lambda,\mu)}-\mathrm{Re}\{\phi_{X1X2}(\lambda,\mu)\}}{1-\mathrm{Re}\{\Gamma_{n1n2}(\lambda,\mu)\}} \quad \text{Equation 3}$$

where $1-\mathrm{Re}\{\Gamma_{n1n2}(\lambda,\mu)\}>0$ has to be ensured for the denominator, for example, an upper threshold of coherence 60 of $\Gamma_{max}=0.99$. The function $\mathrm{Re}\{\cdot\}$ returns the real part of its argument. In different embodiments, the Real parts taken in Equation 3 may not be taken. Additionally, any real parts taken in any of the equation herein may be optional. Furthermore, in different embodiments, the different PSD elements may each be weighted evenly or unevenly.

Once noise estimation module 50 identifies noise estimation 52, speech enhancement module 62 may identify gain 64 of noise reduction system 34. Gain 64 may be the spectral gains applied to first signal 46 and second signal 48 during processing through noise reduction system 34. The equation for gains 64 uses the power level difference between both microphones, as follows:

$$\Delta\phi(\lambda,\mu)=|\phi_{X1X1}(\lambda,\mu)-\phi_{X2X2}(\lambda,\mu)|. \quad \text{Equation 4}$$

When there is pure noise, the above equation results in close to zero, whereas when there is purse speech an absolute value greater than zero is achieved. Additionally, the different embodiments may use another as follows:

$$\Delta\phi(\lambda,\mu)=\max(\phi_{X1X1}(\lambda,\mu)-\phi_{X2X2}(\lambda,\mu),0). \quad \text{Equation 5}$$

In Equation 5, the power level difference is zero when the power level of the second signal is greater than the power level of the first signal. This embodiment recognizes and takes into account that the power level at second microphone 44 should not be higher than power level at first microphone 42. However, in some embodiments, it may be desirable to use 4. For example, when the two microphones are equidistant from speech source 38.

Using the above equation, gains 64 may be calculate as:

$$G(\lambda,\mu)=\frac{\Delta\phi(\lambda,\mu)}{\Delta\phi(\lambda,\mu)+\gamma\cdot|1-H^2(\lambda,\mu)|\cdot\hat{\sigma}_N^2(\lambda,\mu)}, \quad \text{Equation 6}$$

wherein $H(\lambda,\mu)$ is transfer function 66 between first microphone 42 and second microphone 44, $\hat{\sigma}_N^2(\lambda,\mu)$ is noise estimation 52, $\gamma$ is a weighting factor, $\Delta\phi(\lambda,\mu)$ is normalized difference 52, and $G(\lambda,\mu)$ is gain 64.

In the case of an absence of speech, speech source 38 have no output, $\Delta\phi(\lambda,\mu)$ will be zero and hence gain 64 will be zero. When there is speech without noise, plurality of noise sources 40 have no output, the right part of the denominator of Equation 6 will be zero, and accordingly, the fraction will turn to one.

Speech enhancement module 62 may identify transfer function 66 using a ratio 67 of power spectral density 56 of second signal 48 minus noise estimation 52 to power spectral density 54 of first signal 46. Noise estimation 52 is removed from only power spectral density 56 of second signal 48. Transfer function 66 is calculated as follows:

$$H(\lambda, \mu) = \sqrt{\frac{\phi_{X2X2}(\lambda, \mu) - \hat{\sigma}_N^2(\lambda, \mu)}{\phi_{X1X1}(\lambda, \mu)}}, \quad \text{Equation 7}$$

wherein H (λ,μ) is transfer function 66, $\phi_{X1X1}(\lambda,\mu)$ is power spectral density 54 of the first signal 46, $\phi_{X2X2}(\lambda,\mu)$ is power spectral density 56 of second signal 44, and $\hat{\sigma}_N^2(\lambda,\mu)$ is noise estimation 54, which may also be referred to as $\phi_{NN}(\lambda,\mu)$ herein.

In other embodiments, transfer function 66 may be another equation as follows:

$$H(\lambda, \mu) = \sqrt{\frac{\phi_{X2X2}(\lambda, \mu) - \hat{\sigma}_N^2(\lambda, \mu)}{\phi_{X1X1}(\lambda, \mu) - \hat{\sigma}_N^2(\lambda, \mu)}}. \quad \text{Equation 8}$$

In this case, when speech is low, both the numerator and denominator converge near zero.

Additionally, different advantageous embodiments use methods to reduce the amount of musical tones. For examples, in different embodiments, a procedure similar to a decision directed approach which works on the estimation of H(λ,μ) may be used as follows:

$$\xi(\lambda, \mu) = \alpha \cdot \frac{S(\lambda - 1, \mu)^2}{\hat{\sigma}_N^2(\lambda - 1, \mu)} + (1 - \alpha) \cdot \frac{G(\lambda, \mu)}{1 - G(\lambda, \mu)}, \quad \text{Equation 9}$$

and $$G(\lambda, \mu) = \frac{\xi(\lambda, \mu)}{1 - \xi(\lambda, \mu)}, \quad \text{Equation 10}$$

wherein α may be different values in the different equations herein.

Additionally, smoothing over frequency approach may further reduce the amount of musical tones. Additionally, in different embodiments, a gain smoothing may only above a certain frequency range. In other embodiments, a gain smoothing may be applied for none or all of the frequencies.

Additionally, user equipment 34 may include one or more memory elements (e.g., memory element 24) for storing information to be used in achieving operations associated with applications management, as outlined herein. These devices may further keep information in any suitable memory element (e.g., random access memory (RAM), read only memory (ROM), field programmable gate array (FPGA), erasable programmable read only memory (EPROM), electrically erasable programmable ROM (EEPROM), etc.), software, hardware, or in any other suitable component, device, element, or object where appropriate and based on particular needs. Any of the memory or storage items discussed herein should be construed as being encompassed within the broad term 'memory element' as used herein in this Specification.

In different illustrative embodiments, the operations for reducing and estimating noise outlined herein may be implemented by logic encoded in one or more tangible media, which may be inclusive of non-transitory media (e.g., embedded logic provided in an ASIC, digital signal processor (DSP) instructions, software potentially inclusive of object code and source code to be executed by a processor or other similar machine, etc.). In some of these instances, one or more memory elements (e.g., memory element 68) can store data used for the operations described herein. This includes the memory elements being able to store software, logic, code, or processor instructions that are executed to carry out the activities described in this Specification.

Additionally, user equipment 36 may include processing element 70. A processor can execute any type of instructions associated with the data to achieve the operations detailed herein in this Specification. In one example, the processors (as shown in FIG. 5) could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., an FPGA, an EPROM, an EEPROM), or an ASIC that includes digital logic, software, code, electronic instructions, flash memory, optical disks, CD-ROMs, DVD ROMs, magnetic or optical cards, other types of machine-readable mediums suitable for storing electronic instructions, or any suitable combination thereof.

Additionally, user equipment 36 comprises communications unit 70 which provides for communications with other devices. Communications unit 70 may provide communications through the use of either or both physical and wireless communications links.

The illustration of noise reduction system 34 in FIG. 5 is not meant to imply physical or architectural limitations to the manner in which different illustrative embodiments may be implemented. Other components in addition and/or in place of the ones illustrated may be used. Some components may be unnecessary in some illustrative embodiments. Also, the blocks are presented to illustrate some functional components. One or more of these blocks may be combined and/or divided into different blocks when implemented in different advantageous embodiments.

Figure 6:
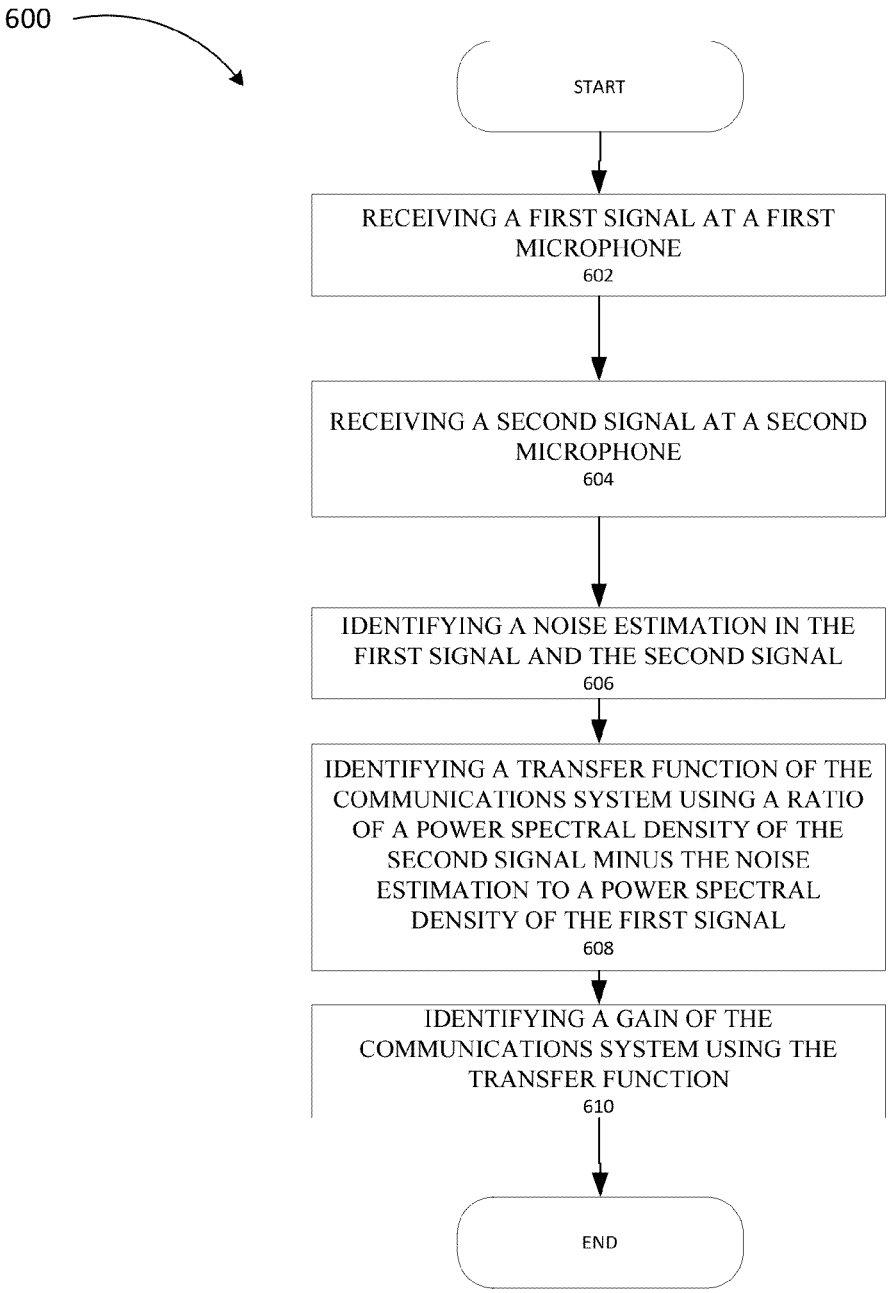
FIG. 6 is a flowchart for reducing noise in a noise reduction system in accordance with an illustrative embodiment.

FIG. 6 is a flowchart for reducing noise in a noise reduction system in accordance with an illustrative embodiment. Process 600 may be implemented in noise reduction system 34 from FIG. 5.

Process 600 begins with user equipment receiving a first signal at a first microphone (step 602). Also, user equipment receives a second signal at a second microphone (step 604). Steps 602 and 604 may happen in any order or simultaneously. User equipment may be a communications device, laptop, tablet PC or any other device that uses microphones.

Then, a noise estimation module identifies noise estimation in the first signal and the second signal (step 606). The noise estimation module may identify a normalized difference in the power spectral density of the first signal and the power spectral density of the second signal and identify the noise estimation based on whether the normalized difference is below, within, or above a specified range.

Next, a speech enhancement module identifies a transfer function of the noise reduction system using a ratio of a power spectral density of the second signal minus the noise estimation to a power spectral density of the first signal (step 608). The noise estimation is removed from only the power spectral density of the second signal. Finally, the speech enhancement module identifies a gain of the noise reduction system using the transfer function (step 610). Thereafter, the process terminates.

Figure 7:
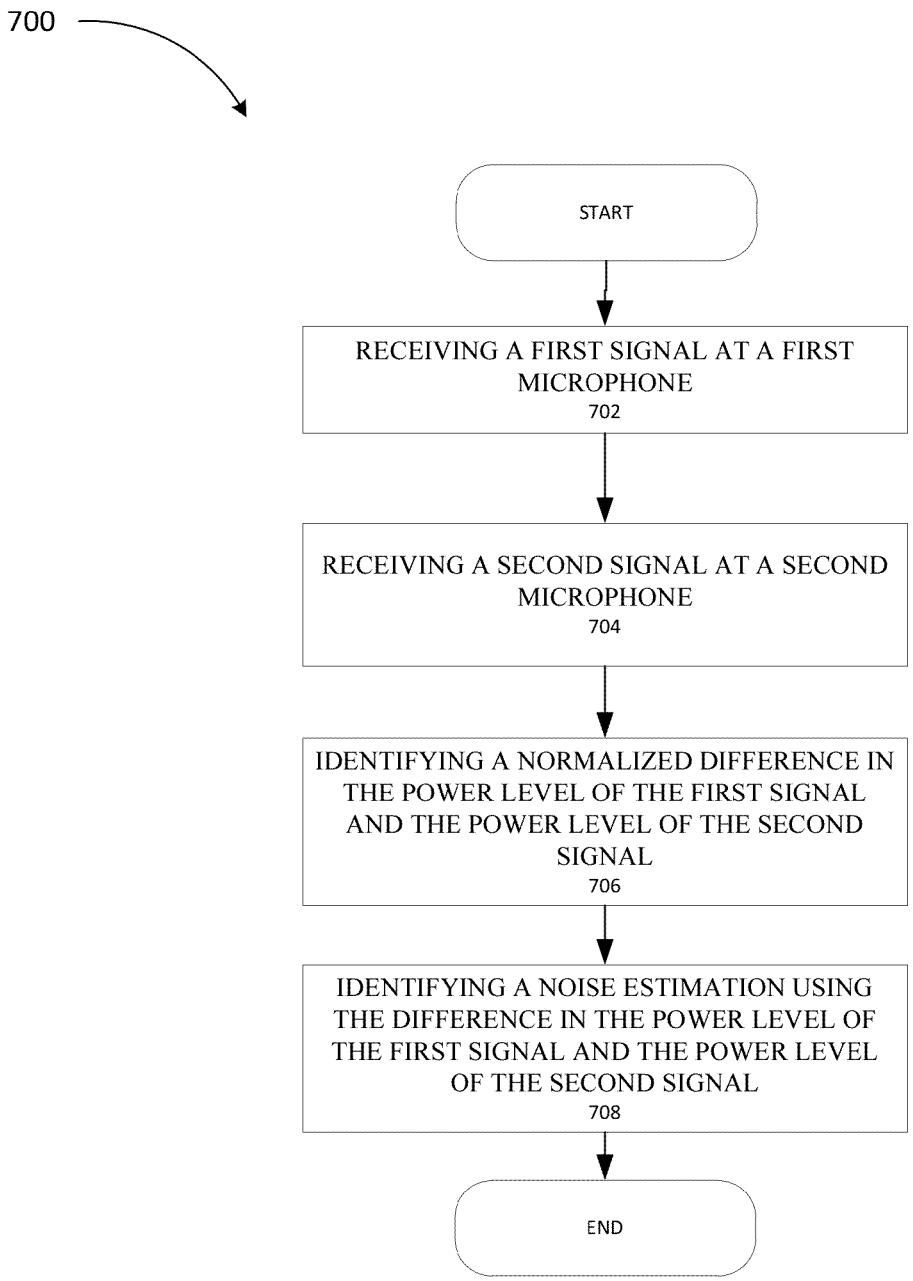
FIG. 7 is a flowchart for identifying noise in a noise reduction system in accordance with an illustrative embodiment.

FIG. 7 is a flowchart for identifying noise in a noise reduction system in accordance with an illustrative embodiment. Process 700 may be implemented in noise reduction system 34 from FIG. 5.

Process 700 begins with user equipment receiving a first signal at a first microphone (step 702). Also, user equipment receives a second signal at a second microphone (step 704). Steps 702 and 704 may happen in any order or simultaneously. User equipment may be a communications device, laptop, tablet PC or any other device that uses microphones.

Then, a noise estimation module identifies a normalized difference in the power spectral density of the first signal and the power spectral density of the second signal (step 706). Finally, the noise estimation module identifies a noise estimation using the difference (step 708). Thereafter, the process terminates.

Figure 8:
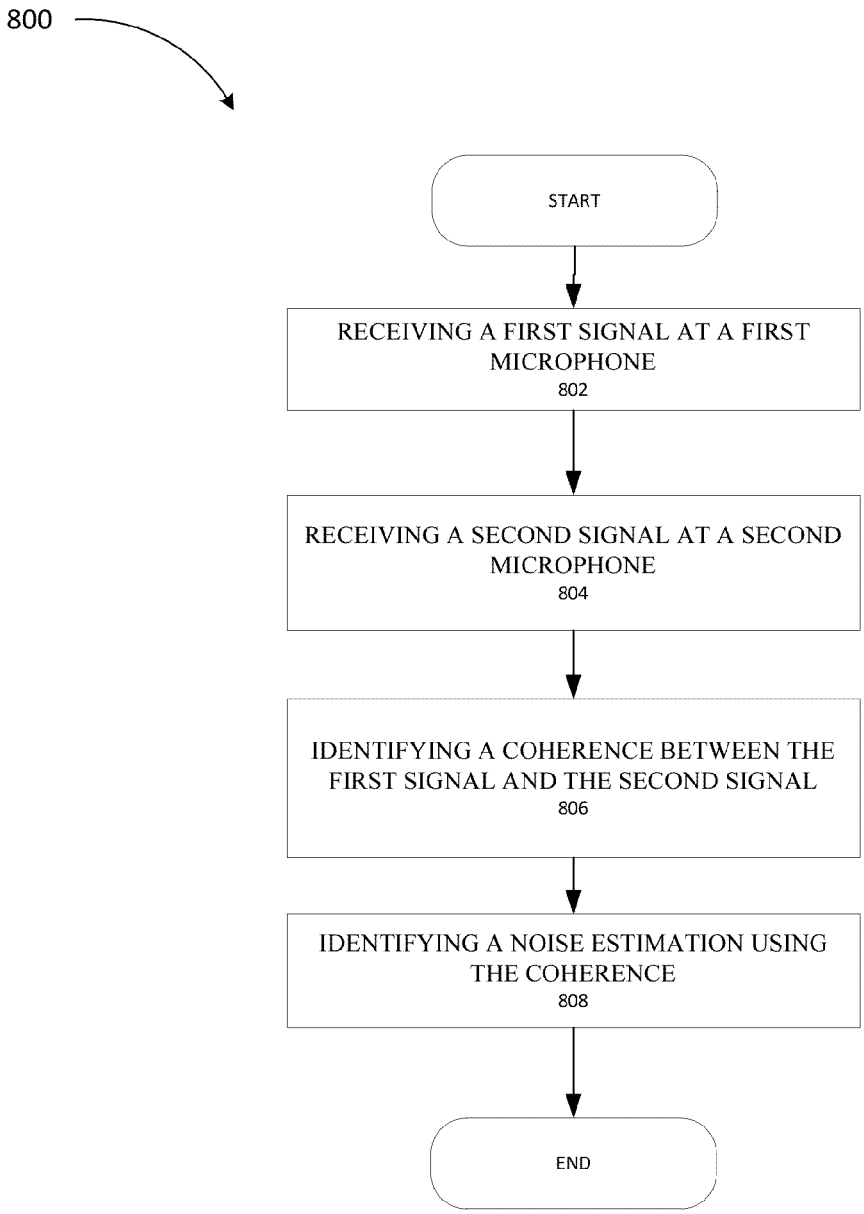
FIG. 8 is a flowchart for identifying noise in a noise reduction system in accordance with an illustrative embodiment.

FIG. 8 is a flowchart for identifying noise in a noise reduction system in accordance with an illustrative embodiment. Process 800 may be implemented in noise reduction system 34 from FIG. 5.

Process 800 begins with user equipment receiving a first signal at a first microphone (step 802). Also, user equipment receives a second signal at a second microphone (step 804). Steps 802 and 804 may happen in any order or simultaneously. User equipment may be a communications device, laptop, tablet PC or any other device that uses microphones.

Then, a noise estimation module identifies coherence between the first signal and the second signal (step 806). Finally, the noise estimation module identifies a noise estimation using the coherence (step 808). Thereafter, the process terminates.

The flowcharts and block diagrams in the different depicted embodiments illustrate the architecture, functionality, and operation of some possible implementations of apparatus, methods, system, and computer program products. In this regard, each block in the flowchart or block diagrams may represent a module, segment, or portion of computer usable or readable program code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

What is claimed is:

1. A method in a noise reduction system comprising at least one processor, the method comprising:

receiving at the at least one processor, a first signal from a first microphone;

receiving at the at least one processor, a second signal from a second microphone;

determining by the at least one processor, a noise estimation based on the first signal and the second signal;

calculating by the at least one processor, a transfer function of the noise reduction system using a ratio of a power spectral density of the second signal minus the noise estimation to a power spectral density of the first signal, wherein the noise estimation is removed from only the power spectral density of the second signal; and calculating by the at least one processor, a gain of the noise reduction system using the transfer function.

2. The method of claim 1, wherein the gain is zero when the power level of the second signal is greater than the power level of the first signal.

3. The method of claim 1, wherein determining the noise estimation comprises:

calculating, by the at least one processor, a normalized difference in the power spectral density of the first signal and the power spectral density of the second signal; and determining, by the at least one processor, the noise estimation based on whether the normalized difference is below, within, or above a specified range.

4. The method of claim 3, wherein the step of calculating the normalized difference in the power spectral density of the first signal and the power spectral density of the second signal comprises using the equation:

$$\Delta\phi(\lambda, \mu) = \frac{\phi_{X1X1}(\lambda, \mu) - \phi_{X2X2}(\lambda, \mu)}{\phi_{X1X1}(\lambda, \mu) + \phi_{X2X2}(\lambda, \mu)}$$

wherein $\Delta\phi(\lambda, \mu)$ is the normalized difference in the power spectral density of the first signal and the power spectral density of the second signal, $\phi_{X1X1}(\lambda,\mu)$ is the power spectral density of the first signal, and $\phi_{X2X2}(\lambda,\mu)$ is the power spectral density of the second signal.

5. The method of claim 1, wherein calculating the transfer function of the noise reduction system comprises using the equation:

$$H(\lambda, \mu) = \sqrt{\frac{\phi_{X2X2}(\lambda, \mu) - \hat{\sigma}_N^2(\lambda, \mu)}{\phi_{X1X1}(\lambda, \mu)}},$$

wherein $H(\lambda,\mu)$ is the transfer function, $\phi_{X1X1}(\lambda,\mu)$ is the power spectral density of the first signal, $\phi_{X2X2}(\lambda,\mu)$ is the power spectral density of the second signal, and $\hat{\sigma}_N^2(\lambda,\mu)$ is the noise estimation.

6. The method of claim 1, wherein calculating the gain comprises using the equation:

$$G(\lambda, \mu) = \frac{\Delta\phi(\lambda, \mu)}{\Delta\phi(\lambda, \mu) + \gamma \cdot |1 - H^2(\lambda, \mu)| \cdot \hat{\sigma}_N^2(\lambda, \mu)};$$

wherein $H(\lambda,\mu)$ is the transfer function, $\hat{\sigma}_N^2(\lambda,\mu)$ is the noise estimation, $\Delta\phi(\lambda,\mu)$ is the normalized difference in the power spectral density of the first signal and the power spectral density of the second signal, and $G(\lambda,\mu)$ is the gain.

7. The method of claim 6, wherein $\Delta\phi(\lambda\mu)=\max(\phi_{X1X1}(\lambda,\mu)-\phi_{X2X2}(\lambda,\mu),0)$.

8. A method in a noise reduction system comprising at least one processor, the method comprising:

receiving by the at least one processor, a first signal from a first microphone;

receiving by the at least one processor, a second signal from a second microphone;

calculating by the at least one processor, a normalized difference in the power spectral density of the first signal and the power spectral density of the second signal; and determining by the at least one processor, a noise estimation using the normalized difference; and calculating by the at least one processor, a transfer function of the noise reduction system using a ratio of a power spectral density of the second signal minus the noise estimation to a power spectral density of the first signal, wherein the noise estimation is removed from only the power spectral density of the second signal.

9. The method of claim 8, wherein the calculating the normalized difference in the power spectral density of the first signal and the power spectral density of the second signal comprises using the equation:

$$\Delta\phi(\lambda,\mu)=\left|\frac{\phi_{X1X1}(\lambda,\mu)-\beta\phi_{X2X2}(\lambda,\mu)}{\phi_{X1X1}(\lambda,\mu)+\beta\phi_{X2X2}(\lambda,\mu)}\right|,$$

wherein $\Delta\phi(\lambda,\mu)$ is the normalized difference in the power spectral density of the first signal and the power spectral density of the second signal, $\beta$ is a weighting factor, $\phi_{X1X1}(\lambda,\mu)$ is the power spectral density of the first signal, and $\phi_{X2X2}(\lambda,\mu)$ is the power spectral density of the second signal.

10. The method of claim 8, further comprising:

calculating by the at least one processor, a gain of the noise reduction system using the transfer function.

11. A method for estimating noise in a noise reduction system comprising at least one processor, the method comprising:

receiving at the at least one processor, a first signal from a first microphone;

receiving at the at least one processor, a second signal at a second microphone;

calculating by the at least one processor, a coherence between the first signal and the second signal;

determining by the at least one processor, a noise estimation using the coherence; and calculating by the at least one processor, a transfer function of the noise reduction system using a ratio of a power spectral density of the second signal minus the noise estimation to a power spectral density of the first signal, wherein the noise estimation is removed from only the power spectral density of the second signal.

12. The method of claim 11, wherein calculating the coherence comprises using the equation:

$$\Gamma_{X1X2}(\lambda,\mu)=\frac{\phi_{X1X2}(\lambda,\mu)}{\sqrt{\phi_{X1X1}(\lambda,\mu)\times\phi_{X2X2}(\lambda,\mu)}}$$

wherein $\Gamma_{X1X2}(\lambda,\mu)$ is the coherence between the first signal and second signal, $\phi_{X1X1}(\lambda,\mu)$ is the power spectral density of the first signal, $\phi_{X2X2}(\lambda,\mu)$ is the power spectral density of the second signal, and $\phi_{X1X2}(\lambda,\mu)$ is the cross power spectral density of the first signal and the second signal.

13. The method of claim 11, wherein determining the noise estimation comprises using the equation:

$$\phi_{NN}(\lambda,\mu)=\frac{\sqrt{\phi_{X1X1}(\lambda,\mu)\times\phi_{X2X2}(\lambda,\mu)}-\{\phi_{X1X2}(\lambda,\mu)\}}{1-\{\Gamma_{X1X2}(\lambda,\mu)\}}$$

wherein $\phi_{NN}(\lambda,\mu)$ is the noise estimation, $\Gamma_{X1X2}(\lambda,\mu)$ is the coherence between the first signal and second signal, $\phi_{X1X1}(\lambda,\mu)$ is the power spectral density of the first signal, $\phi_{X2X2}(\lambda,\mu)$ is the power spectral density of the second signal, and $\phi_{X1X2}(\lambda,\mu)$ is the cross power spectral density of the first signal and the second signal.

14. The method of claim 11, further comprising:

calculating by the at least one processor, a gain of the noise reduction system using the transfer function.

15. A system for reducing noise in a noise reduction system, the system comprising:

a first microphone configured to receive a first signal;

a second microphone configured to receive a second signal;

a noise estimation module configured to determine a noise estimation using the first signal and the second signal;

a speech enhancement module configured to calculate a transfer function of the noise reduction system based on a ratio of a power spectral density of the second signal minus the noise estimation to a power spectral density of the first signal, wherein the noise estimation is removed from only the power spectral density of the second signal, and configured to calculate a gain of the noise reduction system using the transfer function.

16. The system of claim 15, wherein the speech enhancement module calculates the transfer function of the noise reduction system using the equation:

$$H(\lambda,\mu)=\sqrt{\frac{\phi_{X2X2}(\lambda,\mu)-\hat{\sigma}_N^2(\lambda,\mu)}{\phi_{X2X2}(\lambda,\mu)}},$$

wherein $H(\lambda,\mu)$ is the transfer function, $\phi_{X1X1}(\lambda,\mu)$ is the power spectral density of the first signal, $\phi_{X2X2}(\lambda,\mu)$ is the power spectral density of the second signal, and $\hat{\sigma}_N^2(\lambda,\mu)$ is the noise estimation.

17. A system for estimating noise in a noise reduction system, the method comprising:

a first microphone configured to receive a first signal;

a second microphone configured to receive a second signal;

a noise estimation module configured to calculate a normalized difference in the power spectral density of the first signal and the power spectral density of the second signal; and configured to determine a noise estimation using the difference; and a speech enhancement module configured to calculate a transfer function of the noise reduction system using a ratio of a power spectral density of the second signal minus the noise estimation to a power spectral density of the first signal, wherein the noise estimation is removed from only the power spectral density of the second signal.

18. A system for estimating noise in a noise reduction system, the method comprising:

a first microphone configured to receive a first signal;

a second microphone configured to receive a second signal;

a noise estimation module configured to calculate a coherence between the first signal and the second signal and determine a noise estimation using the coherence, wherein the noise estimation module determines the noise estimation using the equation:

$$\phi_{NN}(\lambda,\mu)=\frac{\sqrt{\phi_{X1X1}(\lambda,\mu)\times\phi_{X2X2}(\lambda,\mu)}-\mathrm{Re}\{\phi_{X1X2}(\lambda,\mu)\}}{1-\mathrm{Re}\{\Gamma_{X1X2}(\lambda,\mu)\}}$$

wherein $\phi_{NN}(\lambda,\mu)$ is the noise estimation, $\Gamma_{X1X2}(\lambda,\mu)$ is the coherence between the first signal and second signal, $\phi_{X1X1}(\lambda,\mu)$ is the power spectral density of the first signal, $\phi_{X2X2}(\lambda,\mu)$ is the power spectral density of the second signal, and $\phi_{X1X2}(\lambda,\mu)$ is the cross power spectral density of the first signal and the second signal.

19. The system of claim 18, wherein the noise estimation module calculates the coherence using the equation:

$$\Gamma_{X1X2}(\lambda, \mu) = \frac{\phi_{X1X2}(\lambda, \mu)}{\sqrt{\phi_{X1X1}(\lambda, \mu) \times \phi_{X2X2}(\lambda, \mu)}}$$

wherein $\Gamma_{X1X2}(\lambda,\mu)$ is the coherence between the first signal and second signal, $\phi_{X1X1}(\lambda,\mu)$ is the power spectral density of the first signal, $\phi_{X2X2}(\lambda,\mu)$ is the power spectral density of the second signal, and $\phi_{X1X2}(\lambda,\mu$ is the cross power spectral density of the first signal and the second signal.

20. A computer program product comprising logic encoded on a non-transitory computer-readable tangible media, the logic comprising instructions wherein execution of the instructions by one or more processors causes the one or more processors to carry out steps comprising:

receiving a first signal from a first microphone;

receiving a second signal from a second microphone;

determining a noise estimation using first signal and the second signal;

calculating a transfer function based on a ratio of a power spectral density of the second signal minus the calculated noise estimation to a power spectral density of the first signal, wherein the noise estimation is removed from only the power spectral density of the second signal; and calculating a gain using the transfer function.

21. The computer program product of claim 20, wherein determining the noise estimation comprises:

calculating a normalized difference in the power spectral density of the first signal and the power spectral density of the second signal; and determining the noise estimation based on whether the normalized difference is below, within, or above a specified range.

22. The computer program product of claim 21, wherein calculating the normalized difference in the power spectral density of the first signal and the power spectral density of the second signal comprises using the equation:

$$\Delta\phi(\lambda, \mu) = \left|\frac{\phi_{X1X1}(\lambda, \mu) - \phi_{X2X2}(\lambda, \mu)}{\phi_{X1X1}(\lambda, \mu) + \phi_{X2X2}(\lambda, \mu)}\right|,$$

wherein $\Delta\phi(\lambda,\mu)$ is the normalized difference in the power spectral density of the first signal and the power spectral density of the second signal, $\phi_{X1X1}(\lambda,\mu)$ is the power spectral density of the first signal, and $\phi_{X2X2}(\lambda,\mu)$ is the power spectral density of the second signal.

23. The computer program product of claim 20, wherein calculating the transfer function of the noise reduction system comprises using the equation:

$$H(\lambda, \mu) = \sqrt{\frac{\phi_{X2X2}(\lambda, \mu) - \hat{\sigma}_N^2(\lambda, \mu)}{\phi_{X1X1}(\lambda, \mu)}},$$

wherein $H(\lambda,\mu)$ is the transfer function, $\phi_{X1X1}(\lambda,\mu)$ is the power spectral density of the first signal, $\phi_{X2X2}(\lambda,\mu)$ is the power spectral density of the second signal, and $\hat{\sigma}_N^2(\lambda,\mu)$ is the noise estimation.

24. A computer program product comprising logic encoded on a non-transitory computer-readable tangible media, the logic comprising instructions wherein execution of the instructions by one or more processors causes the one or more processors to carry out steps comprising:

receiving a first signal from a first microphone;

receiving a second signal from a second microphone;

calculating a normalized difference in the power spectral density of the first signal and the power spectral density of the second signal; and determining a noise estimation using the normalized difference; and calculating a transfer function based on a ratio of a power spectral density of the second signal minus the calculated noise estimation to a power spectral density of the first signal, wherein the noise estimation is removed from only the power spectral density of the second signal.

25. A computer program product comprising logic encoded on a non-transitory computer-readable tangible media, the logic comprising instructions wherein execution of the instructions by one or more processors causes the processors to carry out steps comprising:

receiving a first signal from a first microphone;

receiving a second signal from a second microphone;

calculating a coherence between the first signal and the second signal; and determining a noise estimation using the coherence comprising using the equation:

$$\phi_{NN}(\lambda, \mu) = \frac{\sqrt{\phi_{X1X1}(\lambda, \mu) \times \phi_{X2X2}(\lambda, \mu)} - \{\phi_{X1X2}(\lambda, \mu)\}}{1 - \{\Gamma_{X1X2}(\lambda, \mu)\}}$$

wherein $\phi_{NN}(\lambda,\mu)$ is the noise estimation, $\Gamma_{X1X2}(\lambda,\mu)$ is the coherence between the first signal and second signal, $\phi_{X1X1}(\lambda,\mu)$ is the power spectral density of the first signal, $\phi_{X2X2}(\lambda,\mu)$ is the power spectral density of the second signal, and $\phi_{X1X2}(\lambda,\mu)$ is the cross power spectral density of the first signal and the second signal.

26. The computer program product of claim 25, wherein calculating the coherence comprises using the equation:

$$\Gamma_{X1X2}(\lambda, \mu) = \frac{\phi_{X1X2}(\lambda, \mu)}{\sqrt{\phi_{X1X1}(\lambda, \mu) \times \phi_{X2X2}(\lambda, \mu)}}$$

wherein $\Gamma_{X1X2}(\lambda,\mu)$ is the coherence between the first signal and second signal, $\phi_{X1X1}(\lambda,\mu)$ is the power spectral density of the first signal, $\phi_{X2X2}(\lambda,\mu)$ is the power spectral density of the second signal, and $\phi_{X1X2}(\lambda,\mu)$ is the cross power spectral density of the first signal and the second signal.

* * * * *